United States Patent [19]

Hoffmann

[11] Patent Number: 4,512,937

[45] Date of Patent: Apr. 23, 1985

[54] GRID AND FILL SLATS FOR COOLING TOWERS

[75] Inventor: Paul D. Hoffmann, Kirkwood, Mo.

[73] Assignee: Lilie-Hoffman Cooling Towers, Inc., St. Louis, Mo.

[21] Appl. No.: 455,027

[22] Filed: Jan. 3, 1983

[51] Int. Cl.[3] ..... B01F 3/04

[52] U.S. Cl. ..... 261/111; 261/DIG. 11

[58] Field of Search ..... 261/111, 94, DIG. 11, 261/DIG. 72; 264/177 R; 428/57

[56] References Cited

U.S. PATENT DOCUMENTS

| | | | |
|---|---|---|---|
| 1,503,208 | 7/1924 | Prym | 261/DIG. 72 |
| 2,047,444 | 7/1936 | Stedman | 261/94 |
| 2,306,047 | 12/1942 | Elmer | 261/DIG. 11 |
| 2,971,750 | 2/1961 | Boling | 261/111 |
| 3,151,187 | 9/1964 | Comte | 261/DIG. 72 |
| 3,389,895 | 6/1968 | De Flon | 261/111 |
| 3,879,502 | 4/1975 | Furlong et al. | 261/111 |
| 4,133,851 | 1/1979 | Ovard | 261/111 |
| 4,178,333 | 12/1979 | Shepherd | 261/111 |
| 4,181,692 | 1/1980 | Stone | 261/111 |

FOREIGN PATENT DOCUMENTS

| | | | |
|---|---|---|---|
| 805474 | 12/1958 | United Kingdom | 261/DIG. 11 |

OTHER PUBLICATIONS

Marley, Report No. 105A, "GRP Grid Fill Supports", Nov. 27, 1967.

*Primary Examiner*—Richard L. Chiesa

*Attorney, Agent, or Firm*—Gravely, Lieder & Woodruff

[57] ABSTRACT

A cooling tower has hollow fill slats formed in a rectangular cross-sectional configuration from a suitable polymer. These slats are supported on polymer grids, each comprised of an upper section and a lower section which forms a downward extension of the upper section. The two sections for each grid have horizontal and vertical stringers which are arranged in rows and delineate rectangular grid openings through which the slats extend. The two sections overlap, and in the region of overlap the upper section on its horizontal stringers has knuckle-type connectors that interlock with horizontal stringers of the lower section such that the grid openings for the two grid sections are generally in registration in the region of overlap. The upper section also has alignment lips on some of the vertical stringers in the region of overlap, and these lips maintain the lower section properly aligned with the upper section.

19 Claims, 8 Drawing Figures

GRID AND FILL SLATS FOR COOLING TOWERS

BACKGROUND OF THE INVENTION

This invention relates in general to cooling towers and more particularly to grids and fill slats for such towers.

The typical cooling tower of the type used to cool the water that is circulated through the condensers of steamed-powered electrical generating equipment contains a fill located between an elevated distribution basin and a lower collecting basin. Air circulates freely between the two basins, and an elevated stack or fan is usually employed to induce a draft through the region between the two basins. The fill is composed of a multitude of horizontal slats against which warm water from the elevated distribution basin is directed. This water impinges against the fill slats and is dispersed. This in turn transfers heat to the air passing through the fill, much of the heat being lost in evaporating some of the water.

Traditionally, the grids have been fabricated from galvanized wire, and recently it has been the practice to coat the wire of the grids with a polymer. These wire grids are somewhat expensive and difficult to handle. Moreover, in spite of the protective coatings they still corrode.

The slats are normally composed of wood, such as fir or redwood, which has been treated with a preservative. Wood of this type however is expensive and furthermore will eventually rot, in which case it must be replaced.

SUMMARY OF THE INVENTION

One of the principal objects of the present invention is to provide an improved fill arrangement for a cooling tower, with the fill arrangement being highly resistant to corrosion and inexpensive to manufacture and install. Another object is to provide a fill arrangement of the type stated in which all of the grids are injection molded from a polymer. A further object is to provide plastic grids, each of which is composed of a pair of interlocking sections which may be easily joined together at the site of the cooling tower. An additional object is to provide grids of the type stated that are easily handled and transported. Still another object is to provide slats that are hollow and are formed from an extruded polymer.

DESCRIPTION OF THE DRAWINGS

In the accompanying drawings which form part of the specification and wherein like numerals and letters refer to like parts wherever they occur.

DETAILED DESCRIPTION

Figures 1, 7, 8:
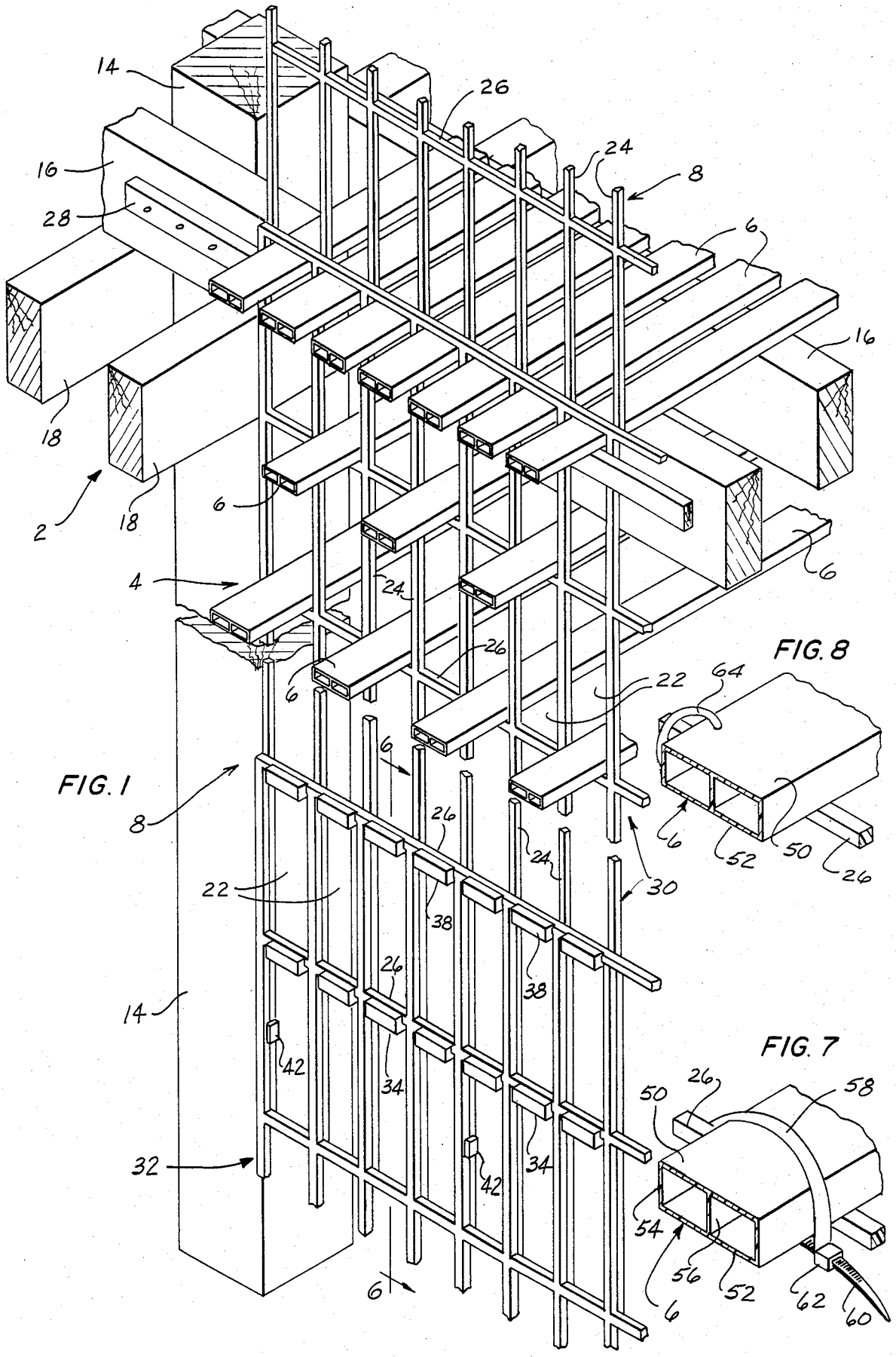
FIG. 1 is a fragmentary perspective view of grid hangers and fill slats constructed in accordance with and embodying the present invention, those hangers and slats being illustrated in conjunction with the framework on which they are supported (the fill slats have been omitted from the region where the grid hanger sections are joined together so as to permit the knuckle connectors at that region to be fully illustrated)
FIG. 7 is a fragmentary perspective view showing a plastic fill slat attached to a grid hanger within a plastic tie.
FIG. 8 is a fragmentary perspective view showing a plastic fill slat secured to a grid hanger with a split ring.

Referring now to the drawings, a cooling tower has a wood framework 2 (FIG. 1) that is erected upon a cooling basin at the base of a cooling tower and extends upwardly from that basin to an elevated distribution basin that is located directly above the collecting basin. The framework 2 supports a fill 4 composed of a multitude of slats 6, each measuring about $\frac{3}{8}'' \times 1\frac{1}{2}''$ in cross-section. The slats 6 are-positioned with their major surface areas extended horizontally, and to this end the slats 6 are extended through grids 8 which are attached to and suspended from the framework 2. In spite of the framework 2, the fill 4 and the grids 8, air circulates freely through the region between the two basins, and indeed a stack or a series of fans is usually employed to induce a draft through this region.

Hot water from the condenser of a steam powered generating facility is pumped into the distribution basin where it is discharged into the fill 6 at numerous nozzles in the floor of the basin. This water cascades through the fill 6, impinging on the fill slats 6 as it does. Hence, the flow from each nozzle is after a short distance dispersed quite widely and finely. This enhances the exposure to the air flow passing through the fill so as to effect a transfer of heat to the air. Some of the heat transfer occurs by mere conduction, but the air evaporates some of the water and this consumes large quantities of heat, thereby effecting a further transfer of heat to the air passing between the two basins.

The framework 2 consists of masts 14 (FIG. 1) that extend upwardly from the collecting basin and transverse and longitudinal ties 16 and 18, respectively, that extend horizontally and are bolted to the masts 14, usually in pairs, with the transverse ties 16 being extended over and resting on the longitudinal ties 18. The masts 14 may be $4 \times 4$ lumber, whereas the ties 16 and 18 need only be $2 \times 4$ lumber which is set on edge. In any event, the lumber of the masts 14 and of the ties 16 and 18 should be treated with a suitable preservative so that it will withstand the moist conditions within the cooling tower. In addition to the masts 14 and the ties 16 and 18, the framework 2 includes bracing to rigidify it.

The grids 8 are actually suspended from the transverse ties 16 of the framework 2, or more precisely from supporting slats 6 that extend over and rest on the transverse ties 16 (FIG. 1). In this regard, each grid 8 has grid openings 22 which are arranged in horizontal and vertical rows, these rows being delineated by vertical stringers 24 and horizontal stringers 26, which are likewise arranged respectively in vertical and horizontal rows. The spacing between adjacent vertical stringers 24, while being slightly greater than the width of the slats 6, is nevertheless considerably less than the spacing between adjacent horizontal stringers 26, so that the grid openings 22 are considerably higher than they are wide. Indeed, the height of each opening 22 should be slightly greater than three times the width of the opening, and should further be somewhat greater than the cross-sectional height of the transverse ties 16, at least for the upper row of openings 22.

Preferably, each grid opening measures about 1 ¾"×5 ¾". In any event, the supporting slats 6 from which each grid 8 is suspended extend through the uppermost row of openings 22 in that grid 8, so that the uppermost horizontal stringers 26 rest on the supporting slats 6 (FIG. 1). Moreover, the upper end of the grid 8 is located adjacent to the transverse tie 16 on which the supporting slats 6 rest and is held against the transverse tie 16 by a stabilizer strip 28 which extends over the vertical stringers 24 at the uppermost row of grid openings 22, so that those stringers are interposed between the tie 16 and the strip 28. The strip 28 is nailed to the side of the transverse tie 16 immediately beneath supporting fill slats 6. More slats 6 extend through some of the remaining openings in an alternating manner, that is such that every other opening 22 in each horizontal row of openings 22 and every other opening 22 in each vertical row of openings 22 contains a slat 6.

Each grid 8 is composed of an upper section 30 and a lower section 32 (FIGS. 1, 2 and 6) which are injection molded from a suitable polymer such as polypropylene. Moreover, the two sections 30 and 32 are identical so they may be formed in the same mold. Prior to installation on the framework 2 the lower section 32 is attached to the lower end of the upper section 30, and this connection may be made in the field or at a remote assembly facility. Once the two sections 30 and 32 are connected together they are firmly interlocked and are very difficult to separate. Thus, they do not come apart in the presence of the normal drafts or occasional high winds encountered in the operation of the cooling tower. The joined together sections 30 and 32 provide the grid 8 that is so formed with a length that is great enough to reach from one transverse tie 16 to the one immediately below it, in which case the openings 22 of the uppermost row of openings 22 lie to the side of the upper transverse tie 16 as previously explained, while the openings 22 of the lowermost row are near the next lower transverse tie 16 with the lowermost horizontal stringer 26 disposed slightly below the upper edge of the lower transverse tie 16. Indeed, the supporting fill slats 6 that rest on the lower tie 16 extend through the grid openings 22 of the lowermost row as well as through the grid openings 22 in the uppermost row of the next grid 8 which is of course the grid 8 that is supported (FIG. 1).

Figure 2:
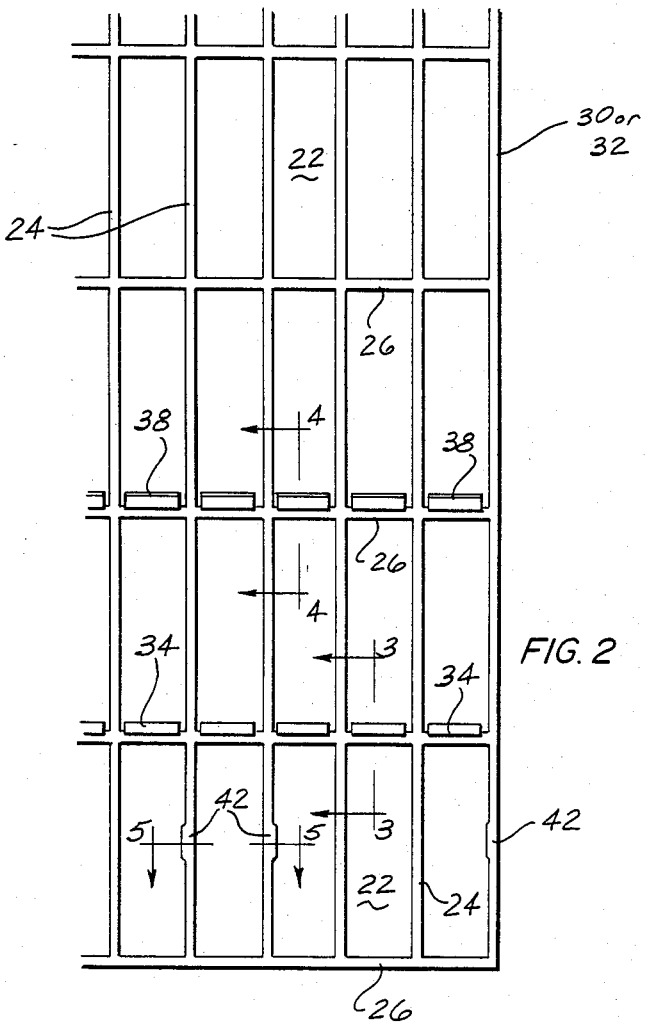
FIG. 2 is a fragmentary elevational view of a grid hanger section constructed in accordance with and embodying the present invention.
Figure 3:
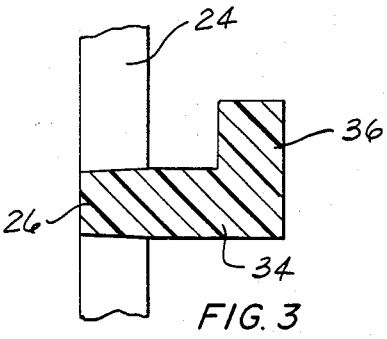
FIG. 3 is a sectional view of one of the lower knuckle connectors taken along line 3—3 of FIG. 2.

Each grid section 30 and 32 has grid openings 22 enclosed by vertical stringers 24 and horizontal stringers 26 (FIG. 2). Indeed these stringers are molded as an integral unit and lie in the same plane, so that the horizontal stringers 26 do not cross over the vertical stringers 24 as is true of wire grids. The next to the lowest row of horizontal stringers 26 has knuckle-type connectors 34 (FIGS. 2 and 3) molded integral with them. Each connector 34 projects horizontally from its stringer 24 and then upwardly in the form of a tab 36, with the space between the tab 36 and the nearby surfaces of the vertical and horizontal stringers 24 and 26 being equal, or perhaps slightly less than the thickness of the stringers 26. Moreover, the connectors 34 are narrower than the grid openings 22 and are centered laterally on the horizontal stringers 26 from which they project. As a consequence adequate space exists between adjacent connectors 24 to receive vertical stringers 24 of the lower grid section 32.

Figure 4:
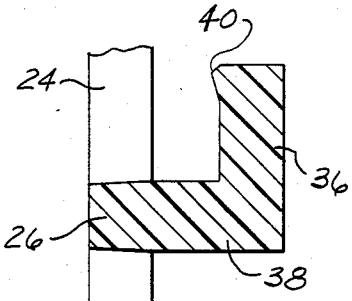
FIG. 4 is a sectional view of one of the upper knuckle connectors taken along line 4—4 of FIG. 2.

The row of horizontal stringers 26 that is located immediately above the row from which the connectors 34 project also has connectors 38 (FIGS. 2 and 4) which project in the same direction as the connectors 34 and indeed are otherwise identical in every aspect to the connectors 34, except that each connector 38 at the upper ends of its tab 36 has a locking lip 40 that projects inwardly toward the grid opening 22 opposite to which the connector 38 lies. The space between the lip 40 and the base of the connector 38 equals the vertical thickness or height of the horizontal stringers 24. The locking lip 40 is not very deep, but it does have beveled upper and lower surfaces.

Figure 5:
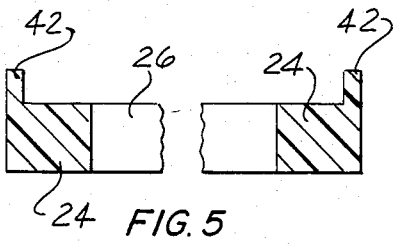
FIG. 5 is a sectional view taken along line 5—5 of FIG. 2 and showing the alignment lips on the lowermost vertical stringers.

Finally, the vertical stringers 24 along several of the grid openings 22 in the lowermost row of openings 22 have alignment lips 42 (FIGS. 2 and 5) formed integral with them, and the spacing between these lips 42 is such that two adjacent vertical stringers 24 will fit between them. Hence, the inside faces of the alignment lips 42 are flush with the side faces of the vertical stringers 24 along which they lie. The alignment lips 42 project from the grid section 30 or 32 in the same direction as do the connectors 34 and 38.

To join the two grid sections 30 and 32 together so as to form one of the grids 8, the upper end of the lower section 32 is aligned laterally with the lower end of the upper section 30, and the lower connectors 34 of the upper section 30 are maneuvered into the grid opening 22 of the next to the uppermost row of openings 22, while the upper connectors 38 are maneuvered into the grid openings 22 of the uppermost row. Indeed, the vertical stringers 24 of the lower section 32 are brought against and aligned with the vertical stringers 24 of the lower section 30, in which case the vertical stringers 24 at the upper end of the lower section 30 will be centered in the gaps between the lower connectors 34 and likewise in the gaps between the upper connectors 36. Moreover, some adjacent vertical stringers 24 at the upper end of the lower section 30 will be between pairs of alignment lips 42 on vertical stringers 24 at the lower end of the upper section 30, thus assuring alignment of the vertical stringers 24 on two sections 30 and 32. However, the connectors 34 and 38 prevent the horizontal stringers 26 of the two sections 30 and 32 from aligning. Indeed, the horizontal stringers 26 of the upper three rows of the lower section 32 are offset vertically upwardly from the horizontal stringers 26 of the lower three rows for the upper section 30.

Figure 6:
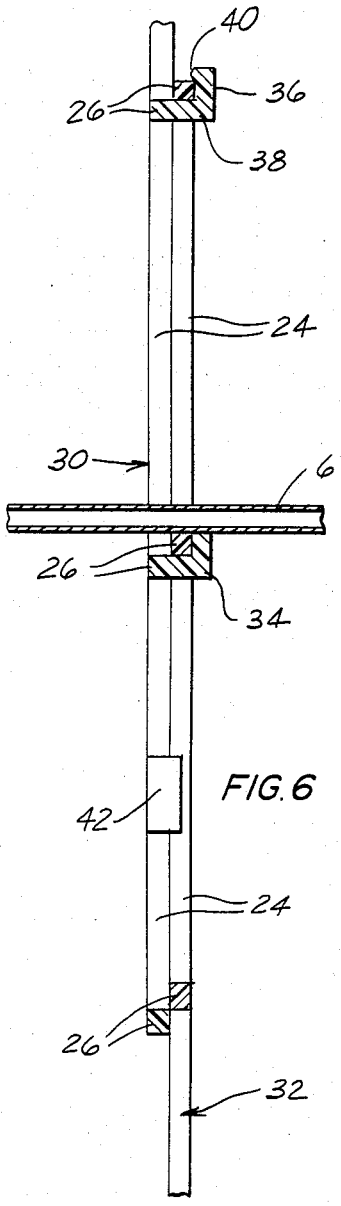
FIG. 6 is a sectional view taken along line 6—6 of FIG. 1 and showing the two sections of the hanger grid joined together by the knuckle type connectors.

Next, the lower section 32 is shifted, and indeed forced, downwardly with respect to the upper section. The vertical stringers 24 of the former slide along the vertical stringers 24 of the latter until the uppermost row of horizontal stringers 26 comes against beveled upper surfaces 42 of the locking lips 40 for the upper connectors 38 or the upper sections 30. At this time the force is increased substantially—indeed to the extent that the horizontal stringers 26 on uppermost row of the lower section 32 are forced past the locking lips 40 and behind the tabs 36 of the upper connectors 38. As the horizontal stringers 26 of the upper row move past the tabs 36 of the upper connectors 38, the horizontal stringers 26 of the next row move behind the tabs 36 of the lower connectors 34. Finally, the horizontal stringers 26 of the two rows bottom out against the bases of their respective connectors 34 and 38, and at the time the locking lips 40 on the upper connectors 38 snap over the upper edges of the horizontal stringers 26 in the uppermost row of the lower section 32. This locks the two sections 30 and 32 firmly together with the openings 22 in their overlapping portions generally in alignment (FIGS. 1 and 6).

The joinder of the two sections 30 and 32 into a grid 8 is simplified by use of a tool having jaws arranged in two rows, there being a pair of jaws for each lower connector 34 and each upper connector 38. Moreover, the spacing between the jaws is such that when they are open, they will receive all of the connectors 34 and 38 at once. Indeed, the connectors 34 and 38 of the upper section 30 are placed in the jaws with the horizontal stringers 26 of the two upper rows for the lower section 32 positioned opposite to those connectors 34 and 38. Then the jaws are closed, whereupon they drive the horizontal stringers 26 for the two upper rows of stringers 26 on the lower section 32 behind the tabs 26 for the connectors 34 and 38 of the upper section 30, thus joining the two sections 30 and 32 firmly together.

Once the grids 8 are assembled from the grid sections 30 and 32, they are suspended from supporting fill slats 6 that are extended over transverse ties 16 of the framework 2 in the manner previously described. This includes installation of the stabilizer strips 28 to secure the grids 8 against their respective transverse ties 16. Thereafter the remaining fill slats 6 are inserted in the grid openings 22 of the grids 8, with each slat being supported by two or more grids 8. These slats 6 are preferably arranged in an alternating manner so that every other grid opening in each horizontal and vertical row of openings 32 contains a slat 6.

Since the grid sections 30 and 32 are identical, more than two sections may be joined together to form grids 8 which will accommodate greater spacing between the transverse ties 16 of the framework 2.

The slats 6 themselves may be made from wood that has been treated with a suitable preservative, but in keeping with durability of the polymer grids 8, it is desirable to also form the slats 6 from a polymer. To this end a slat 6, which is formed from a suitable polymer is produced as an extrusion. The polymer slat 6 is of rectangular cross-sectional configuration and is for the most part hollow. As such it includes top and bottom walls 50 and 52 (FIGS. 7 and 8) on which the major surface areas of the slat 6 exist and side walls 54 which join the top and bottom walls 50 and 52 along side edges of those walls. In addition, the polymer slat 6 includes a center web 56 that connects the top and bottom walls 50 and 52 midway between the side walls 54 to prevent the top and bottom walls 50 and 52 from bowing outwardly.

The polymer slats 6 are considerably lighter in weight than comparable wood slats and to prevent them from being displaced by wind currents passing through the cooling tower, the slats 6 are secured to the horizontal stringers 26 on which they normally rest. To this end, a plastic tie 58 (FIG. 7) is passed over each slat 6 and under at least one of the horizontal stringers 26 on which that slat rests so as to prevent the slat 6 from lifting off of its stringer 26 or turning in the grid openings 22 through which it extends. The tie 58 may have a tail 60 that is serrated on one of its surfaces and a head 62 through which the tail 60, after being doubled back upon itself, is passed. The head 62 contains a pawl that engages the serrations of the tail 60 and thereby prevents the tail 60 from being withdrawn from the head 62.

In the alternative a split metal ring 64 (FIG. 8) may be used to secure the polymer slats 6. Initially, the ring 64 is open, and the spacing between its ends is large enough to accommodate the thickness of the slat 6 and the underlying horizontal stringer 26. Indeed, the open ring 64 is placed over the slat 6 and under the stringer 26, and then is closed such that the upper end of the ring 64 is driven downwardly through the top wall 50 of the slat 6, while the lower end of the ring 64 is displaced upwardly past the side face of the horizontal stringer 26. Indeed, the lower end may even be driven upwardly into the bottom wall 52 of the slat 6. Thus, the ring 64, when properly closed, secures the slat 6 firmly to the underlying stringer 26. The metal ring 64 may be a so-called hog ring which is formed from a corrosion resistant metal and is closed by speciai pliers sold for that purpose.

This invention is intended to cover all changes and modifications of the example of the invention herein chosen for purposes of the disclosure which do not constitute departures from the spirit and scope of the invention.

What is claimed is:

1. A fill arrangement for a cooling tower, said fill arrangement comprising grids positioned vertically with each grid including horizontal and vertical stringers which delineate openings in the grid, the grid being formed from a polymer; slats extended through at least some of the openings in the grids, each slat being supported on the lower horizontal stringer for the opening through which it extends, at least some of the slats being formed entirely from a polymer that is extruded, the extruded polymer slats being hollow and rectangular in cross-sectional configuration, with each including a generally flat top wall, a generally flat bottom wall, and side walls connecting the top and bottom walls along the sides of those walls and also a web connecting the top and bottom walls intermediate the side walls.

2. A fill arrangement according to claim 1 and further comprising means for holding the polymer slats against the horizontal stringers on which they are supported.

3. A fill arrangement according to claim 1 wherein each polymer grid includes upper and lower sections, each containing horizontal and vertical stringers and openings delineated by the stringers, and means for joining the grid sections together such that the lower section forms a downward extension of the upper section.

4. A fill arrangement according to claim 3 wherein for each grid the upper end of the lower section overlaps the lower end of the upper section for that grid such that the vertical stringers of the two grid sections are in alignment.

5. A fill arrangement according to claim 4 wherein the connecting means comprises connectors on horizontal stringers of one of the grid sections, with the connectors being engaged with horizontal stringers on connectors of the other grid section.

6. A fill arrangement according to claim 1 and further comprising a framework having horizontally disposed ties, some of the slats extending over and resting on the ties and these very same slats being extended through the openings at the upper ends of the grids whereby the grids are supported on the framework by means of the slats.

7. In a cooling tower having a fill composed of a multiplicity of slats, an improved grid for supporting slats of the fill, said grid comprising: an upper grid section formed from a polymer and including horizontal and vertical stringers which define openings in the grid; a lower grid section also formed from a polymer and including horizontal and vertical stringers which define more openings in the grid, the upper end of the lower section overlapping the lower end of the upper section such that the openings in the overlapping portions of the two grid sections are generally in registration; and knuckle-type connectors projecting outwardly from horizontal stringers on the upper grid section and then upwardly in the form of tabs, the connectors engaging horizontal stringers on the lower grid section such that the engaged horizontal stringers of the lower section are behind the tabs of the connectors, whereby the grid sections are joined together with the lower grid section forming a downward extension of the upper grid section.

8. The structure according to claim 7 wherein the horizontal stringers of the two sections are arranged in rows and the connectors are on the horizontal stringers of two of the rows.

9. The structure according to claim 8 wherein the connectors are on the horizontal stringers of the next to lowermost row of horizontal stringers and on the row of horizontal stringers immediately above the next to lowermost row, and the connectors on these two rows of stringers engage the horizontal stringers of the uppermost row and the next to the uppermost row of stringers on the lower section.

10. The structure according to claim 9 and further comprising alignment lips on some of the vertical stringers that are below the connectors on the upper section, the alignment lips being positioned to engage vertical stringers on the lower section and align those stringers with corresponding stringers of the upper section.

11. The structure according to claim 7 wherein some of the tabs on the connectors have locking lips which project over the upper edges at horizontal stringers which are engaged by those connectors, whereby the upper and lower grid sections are interlocked.

12. The structure according to claim 7 wherein the upper and lower grid sections are identical and the horizontal and vertical stringers and the connectors of each grid section are all formed integral to one another and constitute a single mass of polymer.

13. In a cooling tower having a fill formed from a multiplicity of slats, an improved grid for supporting slats of the fill, said grid comprising: an upper grid section formed from a polymer and including horizontal and vertical stringers which define openings in the grid; a lower grid section also formed from a polymer and including horizontal and vertical stringers which define more openings in the grid, the upper end of the lower section overlapping the lower end of the upper section such that horizontal stringers in the lower section are adjacent to horizontal stringers in the upper section at more than one elevation; and connectors joining adjacent horizontal stringers of the upper and lower sections together, with each connector preventing the lower section from moving downwardly with respect to the upper section and further preventing the lower section from moving laterally away from the upper section, the connectors being arranged at least in two elevations in the overlapping regions of the upper and lower sections, whereby the lower section is firmly attached to the upper section to form a downward extension of the upper section.

14. The structure according to claim 13 wherein the grid openings in the overlapping regions of the grid sections are generally in registration.

15. The structure according to claim 13 wherein the connectors project horizontally from horizontal stringers on one of the sections and along the adjacent horizontal stringers of the other section to support the lower section, and further extend vertically along the adjacent horizontal stringers to prevent the two sections from moving laterally apart.

16. The structure according to claim 15 wherein the connectors are mounted on horizontal stringers of the upper section and project laterally from such stringers and thence upwardly in the form of a tab.

17. The structure according to claim 15 wherein the tabs of some of the connectors project vertically beyond the adjacent horizontal stringers of the other section and beyond such adjacent stringers are provided with lips which interfere with the adjacent horizontal stringers to retain those stringers in the connectors.

18. The structure according to claim 13 and further comprising alignment means for maintaining the vertical stringers of the two sections generally in alignment.

19. The structure according to claim 18 wherein the alignment means comprises lips that project outwardly from the vertical stringers of one of the sections and are alongside vertical stringers of the other section in the region where the two sections overlap.

* * * * *